US007310828B2

(12) United States Patent
Johnson

(10) Patent No.: US 7,310,828 B2
(45) Date of Patent: Dec. 25, 2007

(54) COLLAPSIBLE HAT WITH SPRING

(75) Inventor: Keith Edgar Johnson, Colorado Springs, CO (US)

(73) Assignee: Elope, Inc., Colorada Springs, CO (US)

( * ) Notice: Subject to any disclaimer, the term of this patent is extended or adjusted under 35 U.S.C. 154(b) by 0 days.

(21) Appl. No.: 10/969,499

(22) Filed: Oct. 20, 2004

(65) Prior Publication Data

US 2006/0080758 A1 Apr. 20, 2006

(51) Int. Cl.
*A42B 1/00* (2006.01)

(52) U.S. Cl. ..... 2/209.12; 2/171.03

(58) Field of Classification Search ..... 2/171.03, 2/209.12; 446/27

See application file for complete search history.

(56) References Cited

U.S. PATENT DOCUMENTS 1,902,080 A * 3/1933 Jordan ..... 2/182.2
3,496,574 A * 2/1970 Liverant ..... 2/175.4
4,709,422 A * 12/1987 Peham ..... 2/171
5,724,678 A * 3/1998 McCallum et al. ..... 2/209.13
5,845,339 A * 12/1998 Ashley et al. ..... 2/195.6

* cited by examiner

*Primary Examiner*—Katherine Moran

(57) ABSTRACT

A collapsible hat, comprising a crown formed of a flexible or bendable material, with inner and outer portions, a brim attached to the inner portion of the crown, a spring connected between the inner and outer portions of the crown for holding the crown in an upright or open state, the spring being collapsible so that the crown can be flattened against the brim for collapsing the hat into a flattened state.

4 Claims, 2 Drawing Sheets

COLLAPSIBLE HAT WITH SPRING

TECHNICAL FIELD

This invention relates to the field of novelty hats and, more particularly, to a hat that is collapsible and can easily be shipped in its collapsed state, and which has a spring that opens the hat when it is removed from a box or shipping container and holds the hat open.

BACKGROUND OF THE INVENTION

Novelty hats take many shapes and configurations. One such hat resembles a formal top hat and can be used by magicians or included in magic kits. The problem with hats having this shape that they are difficult to ship because they typically have a large a large crown portion and require a relatively large box or shipping container. This problem is exacerbated when the hats are manufactured overseas and must be shipped in bulk to a U.S. distributor. The shipping containers for a large number of these hats are unreasonably large and bulky.

Another such hat is a floppy-style hat with a brim and crown that can be collapsed onto the brim. However, these hats have no structural integrity in the crown when it is worn and the crown will not remain upright.

BRIEF SUMMARY OF THE INVENTION

The present invention is directed to a hat that solves the problems discussed above. The hat has a crown portion that is formed of a material that is flexible or bendable enough that the crown can be collapsed or folded onto itself, into a flat configuration that sits on, in or adjacent to the brim. The hat can easily be packaged and shipped in this flat state and allow for space efficient packaging by taking up far less room than when the hat is open.

The crown is provided with sufficient structural integrity that the crown will remain upright when the hat is worn. The structural integrity is provided by a spring that is positioned inside or adjacent to the crown so that when the hat is taken out the box the hat opens by itself. The spring is stiff enough to provide the hat with structural integrity and hold the crown open when the hat is in use. The spring can be collapsed when it is desired to return the hat to its flattened state by pushing the top of the crown toward the brim.

The hat can include a hidden compartment in the crown that is formed by a flap of material that is attached to the inner surface of the crown. The hidden compartment can have a stiff member attached to the material to define the edge of a flap that forms an opening for access to the compartment. The secret compartment can be used by magicians for storing items for use in performing magic tricks or by children who want to keep items in a secret hiding place.

The invention also involves a method of providing a number of hats with springs in them that can be collapsed, collapsing the hats and storing them in one or more shipping containers, shipping the hats in a collapsed state and, when they are desired to be used, removing the hats from the shipping container and allowing springs positioned in the hats to open them.

The foregoing has broadly outlined the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
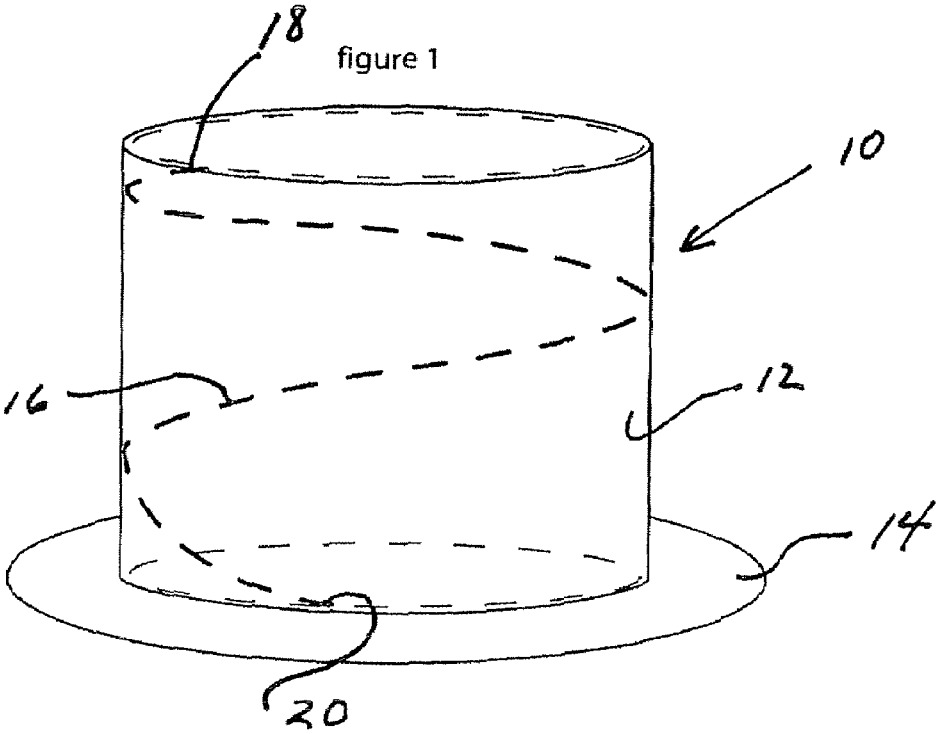
FIG. 1 is a perspective view of an open hat with the dotted lines showing the spring inside.

Referring to FIG. 1, the collapsible hat is identified by reference numeral 10. The hat 10 is formed with a crown 12 and a brim 14. The hat can be formed of any suitable material such a woven fabric or plastic that allows the crown to be collapsed or folded flat against the brim 10.

The hat 10 is designed so that it can be collapsed into a flattened state to allow it to be shipped in smaller space efficient containers by taking up far less room than when the hat is open as shown in FIG. 1. The hat is formed with coil spring 16 that is located in the crown 12 and is connected at or near the top of the hat and at one end 18 and at or near the brim at the other end 20. The connections can be made by sewing, stapling or gluing the spring to the hat material. Other ways of connecting the spring to the hat material can be used as long as the connection is maintained when the hat is in its open and collapsed conditions.

The spring is located preferably inside the crown 12, but can positioned at other convenient locations such as between layers of material that form the crown 12, or on the outside of the crown. The spring 16 provides structural integrity to the crown 12 and holds it upright when the hat is being used. The force of the spring 16 can easily be overcome to flatten the crown 12 against the brim 14 when it is desired to place the hat in a collapsed state.

One advantage of the spring as described is that one or more hats can be shipped or stored in their flattened state in order to save space. If, for example, a number of hats are shipped overseas in a container, many more hats can be shipped in a container in their collapsed state than when the hats are open. The hats can also be packaged and sold in flat boxes that are much smaller and more convenient to handle and store than if the hats are in an open state and in much larger and bulkier boxes.

Another advantage of the spring is that it can provide structural integrity to a crown form of a flexible or bendable material when the hat is in an open state and being worn. When the hats are removed from their boxes, the spring will open the crown and maintain the hat in its open state without any other manipulation. This allows small children to open the box and enjoy the hat immediately without the need for instructions on how to open it.

Figure 2:
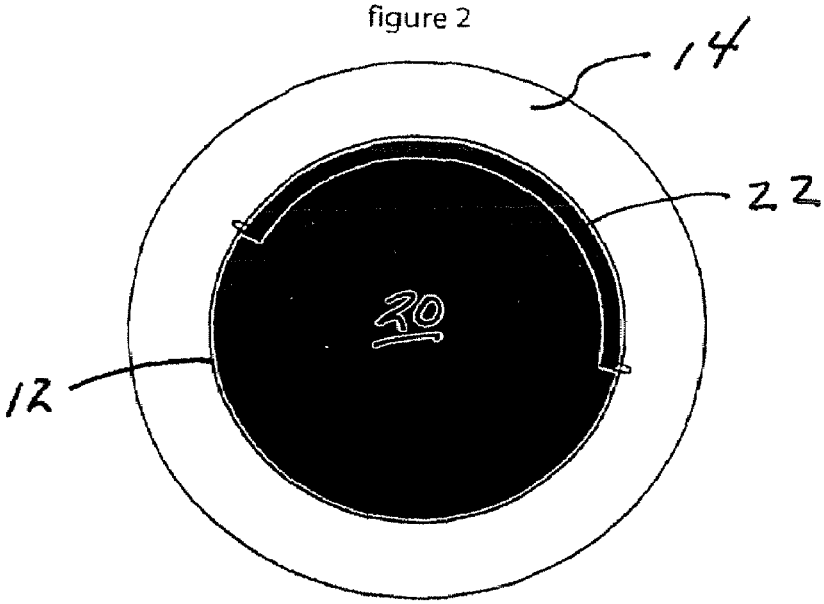
FIG. 2 is a plan view looking inside the hat showing the connection between the spring and the crown and the material that creates a false bottom on the hat.
Figure 3:
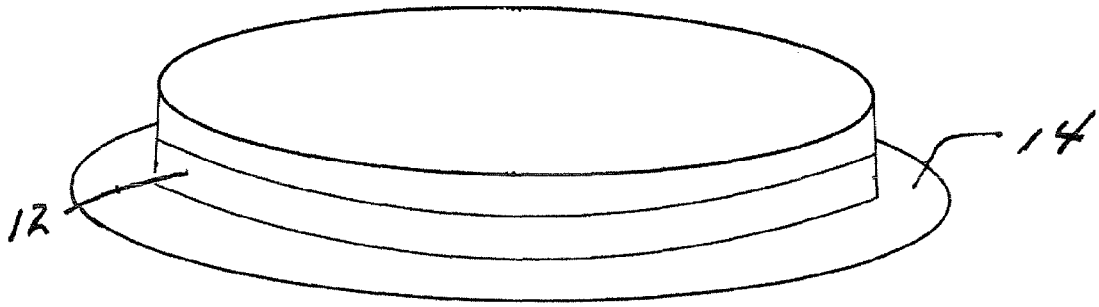
FIG. 3 is a plan view showing the hat in a collapsed condition.

The hat can also be provided with a hidden compartment so that magicians and others can store items in the compartment away from view. Such a compartment can formed by sewing or otherwise connecting a piece of material 20, shown in FIG. 2, to the inside of the crown 12. Access to the compartment can be had through an opening formed by attaching a piece of bent or curved plastic 22 to the material 20 as shown in FIG. 2. The plastic piece 22 provides enough structural integrity to the material to keep the compartment closed and also allow access when desired.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A collapsible hat, comprising:

a. a brim, b. a crown formed of a flexible or bendable material that is capable of being moved between an upright or open state and a flattened state, the crown having an inner end attached to the brim and an outer end flattened against the brim when the crown is in its flattened state and spaced from the brim when the crown in its upright or open state, c. a coil spring movable between collapsed and expanded positions, the coil spring being disposed inside the crown and connected between the inner and outer ends of the crown for holding the crown in an upright or open state relative to the brim when the spring is in its expanded position, the coil spring engaging the inner and outer ends of the crown for biasing the crown in the expanded or open position and being movable between the expanded position and the collapsed position so that the crown can be flattened against the brim for collapsing the hat into a flattened state when the spring is moved into the collapsed position.

2. The collapsible hat of claim 1, wherein the coil spring is positioned inside the crown.

3. The collapsible hat of claim 2, wherein a secret compartment is formed inside the outer end of the crown.

4. The collapsible hat of claim 3, wherein the secret compartment has an opening formed of a bent or curved piece of stiff material.

* * * * *